US010017925B1

(12) United States Patent
Kuo

(10) Patent No.: US 10,017,925 B1
(45) Date of Patent: Jul. 10, 2018

(54) OVERFLOW PIPE ASSEMBLY FOR BATHTUBS

(71) Applicants: Kuang-Ming Kuo, New Taipei (TW); BRIDGING PARTNERS CORPORATION, Taipei (TW); JB PRODUCTS, South Bend, IN (US)

(72) Inventor: Kuang-Ming Kuo, New Taipei (TW)

(73) Assignees: Kuang-Ming Kuo, New Taipei (TW); Bridging Partners Corporation, Taipei (TW); JB Products, South Bend, IN (US)

( * ) Notice: Subject to any disclaimer, the term of this patent is extended or adjusted under 35 U.S.C. 154(b) by 0 days.

(21) Appl. No.: 15/715,376

(22) Filed: Sep. 26, 2017

(30) Foreign Application Priority Data

Aug. 9, 2017 (TW) ..... 106211704 U

(51) Int. Cl.
*E03C 1/12* (2006.01)
*E03C 1/24* (2006.01)

(52) U.S. Cl.
CPC ..... *E03C 1/24* (2013.01); *E03C 2001/2413* (2013.01)

(58) Field of Classification Search
CPC ..... E03C 1/22; E03C 1/2306; E03C 1/232; E03C 1/24; E03C 1/244; E03C 2001/2413
USPC ..... 4/295, 679–680, 683–684, 686, 694
See application file for complete search history.

(56) References Cited

U.S. PATENT DOCUMENTS 5,749,561 A * 5/1998 Worthington ..... A47K 1/14 251/229
6,058,525 A * 5/2000 Paden ..... E03C 1/24 4/287
6,073,278 A * 6/2000 Ball ..... E03C 1/24 4/694
6,546,573 B1 * 4/2003 Ball ..... E03C 1/22 285/361
6,618,875 B1 * 9/2003 Oropallo ..... E03C 1/24 4/694

* cited by examiner

*Primary Examiner* — Erin Deery
*Assistant Examiner* — Nicholas Ros
(74) *Attorney, Agent, or Firm* — Rosenberg, Klein & Lee

(57) ABSTRACT

An overflow pipe assembly of a bathtub includes an overflow pipe having a horizontal fitting end which has outer threads on outside thereof. A flange extends from the outside of the fitting end. A buffering ring is mounted to the fitting end and clamped between the flange and the wall of the bathtub. Two slots are defined axially in the passage of the fitting end. A locking ring is threadedly connected to the outer threads of the overflow pipe. A cap is mounted to the fitting end and has a peripheral wall which includes multiple drain holes. The cap has a tubular portion inserted into the passage. The tubular portion has a central hole which communicates with apertures defined through the wall of the tubular portion. The tubular portion has two protrusion which are engaged with the slots of the fitting end.

7 Claims, 5 Drawing Sheets

OVERFLOW PIPE ASSEMBLY FOR BATHTUBS

BACKGROUND OF THE INVENTION

1. Fields of the Invention

The present invention relates to an overflow pipe assembly of a bathtub, and more particularly, to an overflow pipe that is connected to the cap and is not connected with the locking ring.

2. Descriptions of Related Art

The conventional overflow pipe is connected to the overflow port in the bathtub so that the exceed water can drained from the bathtub, and does not flood on the floor of the bathroom. U.S. Pat. No. 6,637,050 which comprises an overflow pipe having an upper end portion and a lower end portion. The upper end portion has an outer end defining an inlet for being fitted through the bathtub overflow port. Threads are formed on the outer surface of the upper end portion and surround the inlet and normally extend through the bathtub overflow port. A lip extends radially outwardly from the outer surface of the overflow pipe between the elbow portion and the upper end portion and is spaced from the inlet to engage an outer surface of the bathtub end wall around the bathtub overflow port. A thin diaphragm seals the outer end of the upper end portion to close the inlet to fluid flow. A nut element is compatible with the threads wherein the nut element has a threaded portion for threadedly mounting the nut to the upper end portion to clamp the overflow fitting to the end of the bathtub between the lip and the nut element.

It is noted that nut element and the upper end portion are both made of metal, and there are manufacturing tolerance formed between the threads. When the nut is threadedly moves forward, the overflow pipe may move inward relative to the bathtub. There is no stop feature to stop the movement of the overflow pipe when installation so that the length of the threaded section between the nut element and the upper end portion of the overflow pipe becomes shorter than expected. The overflow pipe may shake and eventually cause leakage. Therefore, the workers have to take extra caution to ensure that the overflow pipe does not move backward too far. This may prolong time required of installation.

The present invention intends to provide an overflow pipe assembly of a bathtub and which eliminates the shortcomings mentioned above.

SUMMARY OF THE INVENTION

The present invention relates to an overflow pipe assembly of a bathtub, and comprises an overflow pipe having a fitting end horizontally formed on one end thereof. A passage is defined through the overflow pipe and communicates with the fitting end. The fitting end has outer threads formed on the outside thereof. A flange extends from the outside of the fitting end and located at a distance from the distal end of the fitting end. The diameter of the flange is larger than that of the fitting end. A buffering ring is mounted to the fitting end. The diameter of the buffering ring is smaller than the diameter of the flange. The buffering ring is clamped between the flange and the wall of the bathtub. Two slots are defined axially in the inner periphery of the passage of the fitting end. A locking ring has inner threads defined in the inner periphery thereof, and the inner threads of the locking ring are threadedly connected to the outer threads of the overflow pipe.

A cap is mounted to the distal end of the fitting end and has a peripheral wall which includes multiple drain holes defined therethrough. A tubular portion extends centrally and axially from the inner bottom of the cap. The tubular portion is inserted into the passage and has a central hole. Multiple apertures are defined through the wall of the tubular portion and communicate with the central hole and the drain holes. Two protrusion protrude from outside of the tubular portion and are engaged with the two slots to connect the tubular portion to the overflow pipe. The peripheral wall of the cap is mounted to outside of the locking ring.

The primary object of the present invention is to provide an overflow pipe assembly wherein the locking ring is directly connected to the fitting end of the overflow pipe. The buffering ring absorbs the axial force when the locking ring is threadedly connected to the fitting end of the overflow pipe to prevent the overflow pipe from moving backward.

Another object of the present invention is to provide an overflow pipe assembly wherein the tubular portion of the cap is securely inserted into to the fitting end of the overflow pipe by engagement of the protrusions on the tubular portion and the slots in the fitting end. The cap does not rotate relative to the fitting end.

Yet another object of the present invention is to provide an overflow pipe assembly wherein the two protrusions on the tubular portion have different widths, and the two slots in the overflow pipe have different widths so as to avoid from incorrect installation and to ensure the apertures of the cap to be positioned correctly.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
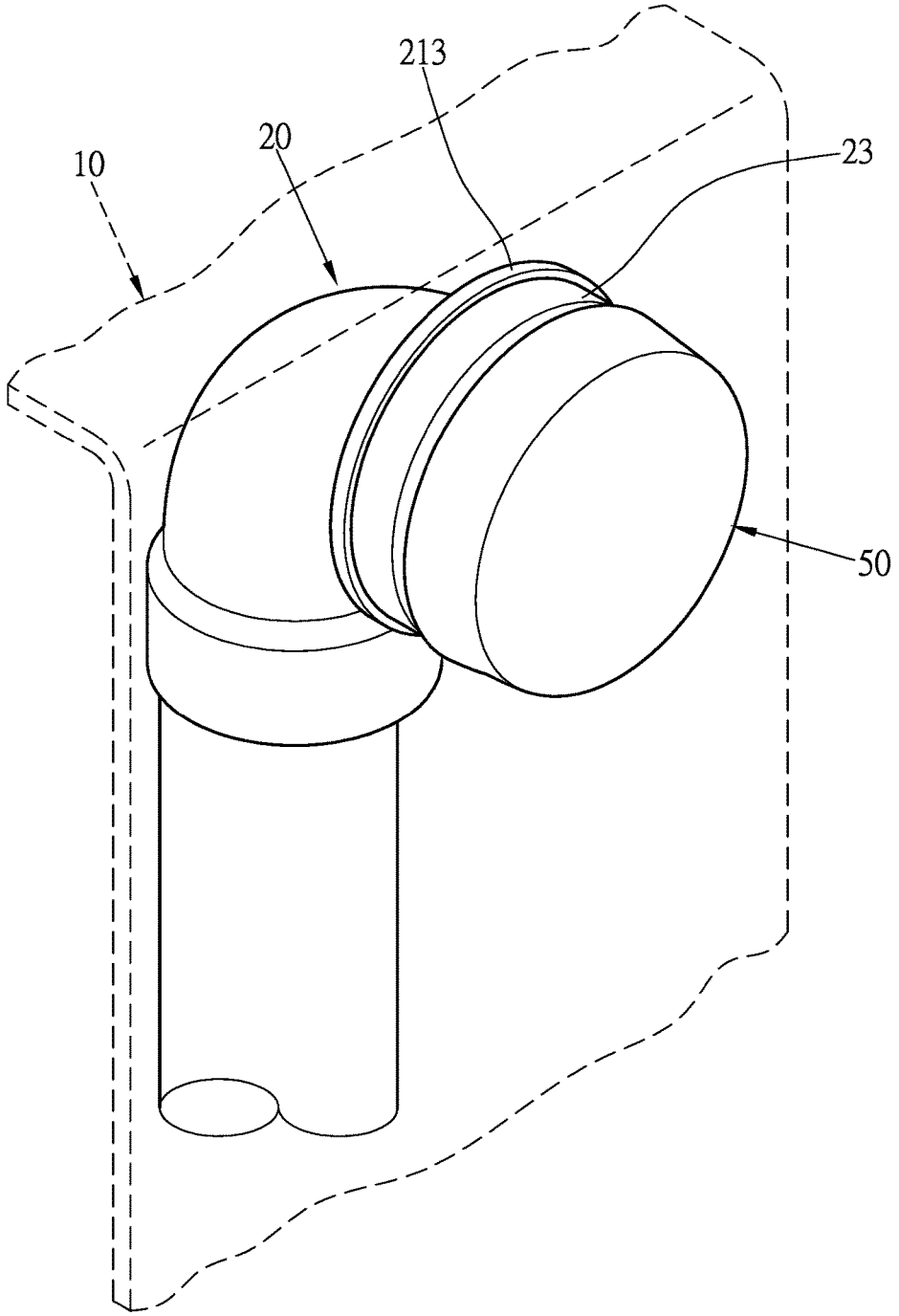
FIG. 1 is a perspective view to show the overflow pipe assembly of the present invention.
Figure 2:
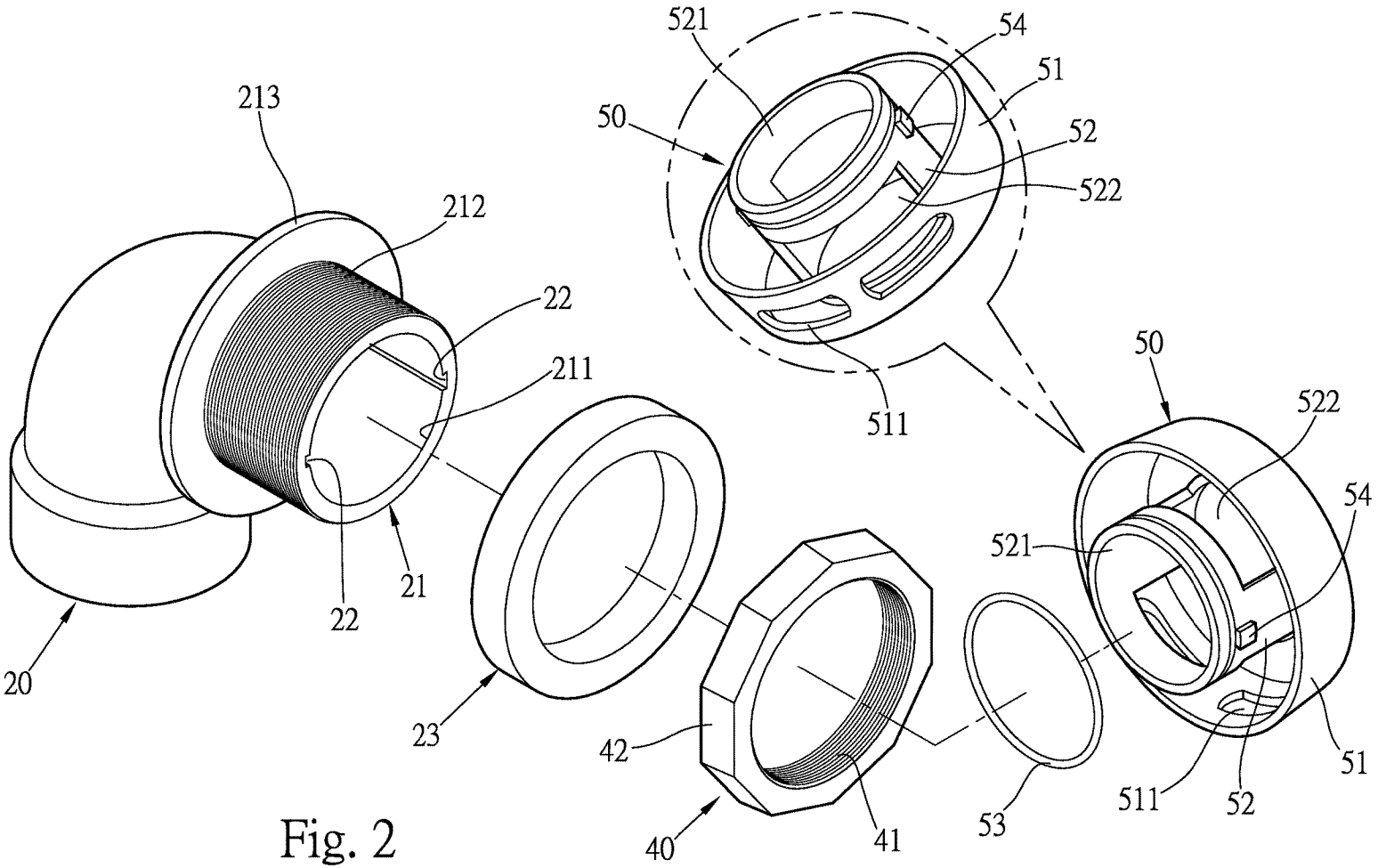
FIG. 2 is an exploded view of the overflow pipe assembly of the present invention.
Figure 3:
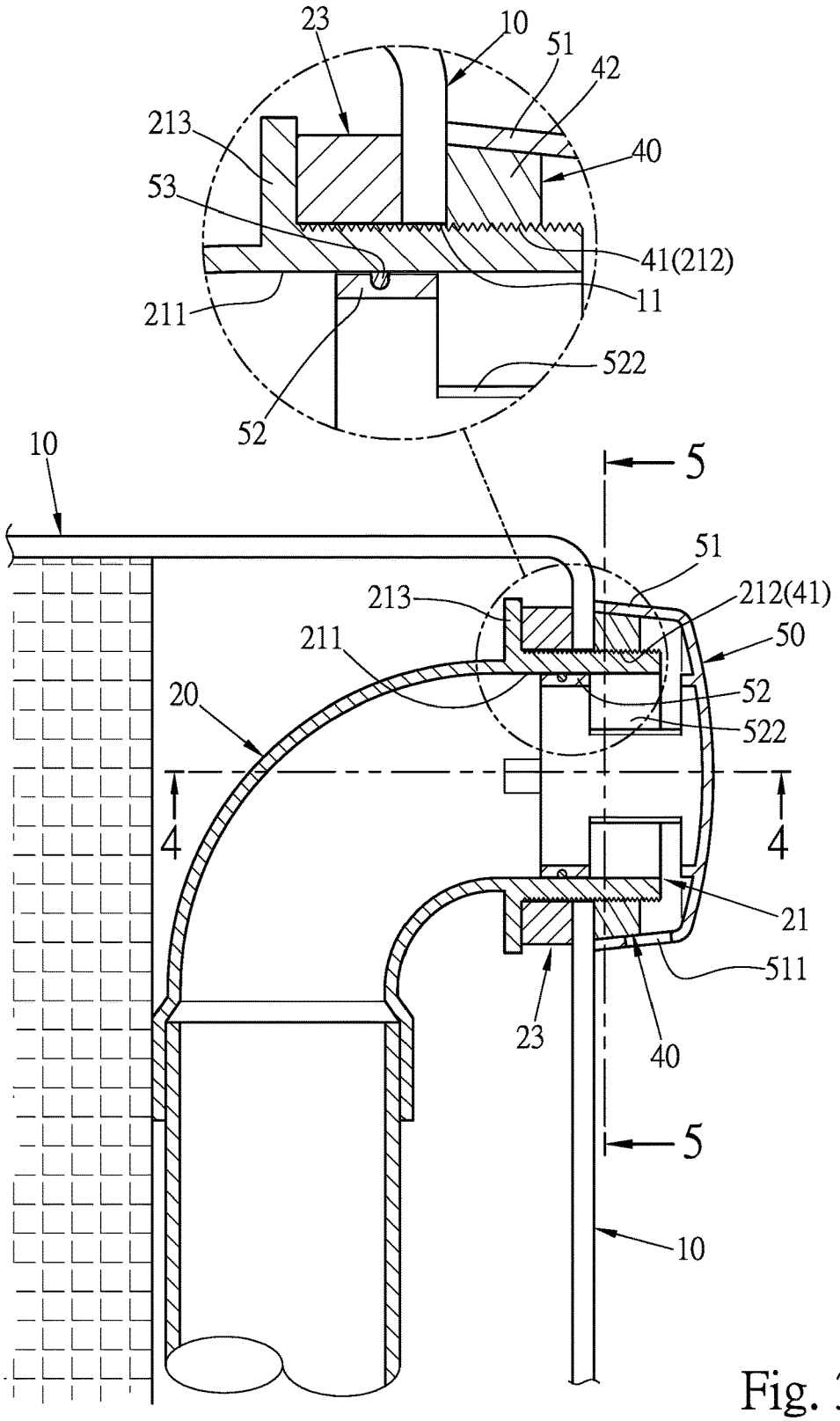
FIG. 3 is a cross sectional view to show that the overflow pipe assembly of the present invention is installed to a bathtub.

Referring to FIGS. 1 to 5, the overflow pipe assembly of the present invention comprises an overflow pipe 20 having a fitting end 21 horizontally formed on one end thereof. A passage 211 is defined through the overflow pipe 20 and communicates with the fitting end 21. The fitting end 21 has outer threads 212 formed on the outside thereof. A flange 213 extends from the outside of the fitting end 21 and located at a distance from the distal end of the fitting end 21. The diameter of the flange 213 is larger than that of the fitting end 21. A buffering ring 23 is mounted to the fitting end 21. The diameter of the buffering ring 23 is smaller than the diameter of the flange 213. The first end face of the buffering ring 23 contacts the flange 213, and the second end face of the buffering ring 23 contacts the wall of the bathtub 10 as shown in FIG. 3. In other words, the buffering ring 23 is clamped between the flange 213 and the wall of the bathtub 10. Two slots 22 are defined axially in the inner periphery of the passage 211 of the fitting end 21. A locking ring 40 has inner threads 41 defined in the inner periphery thereof, and the locking ring 40 includes a polygonal driving portion 42 on outside thereof so that the users can use a wrench to lock the locking ring 40. When the fitting end 21 extends through the overflow port 11 of the bathtub 10, the inner threads 41 of the locking ring 40 are threadedly connected to the outer threads 212 of the overflow pipe 20 to secure the fitting end 21 relative to the wall of the bathtub 10. The buffering ring 23 absorbs the axial force when the locking ring 40 is threadedly connected to the fitting end 21 of the overflow pipe 20 to prevent the overflow pipe 20 from moving backward.

Figure 4:
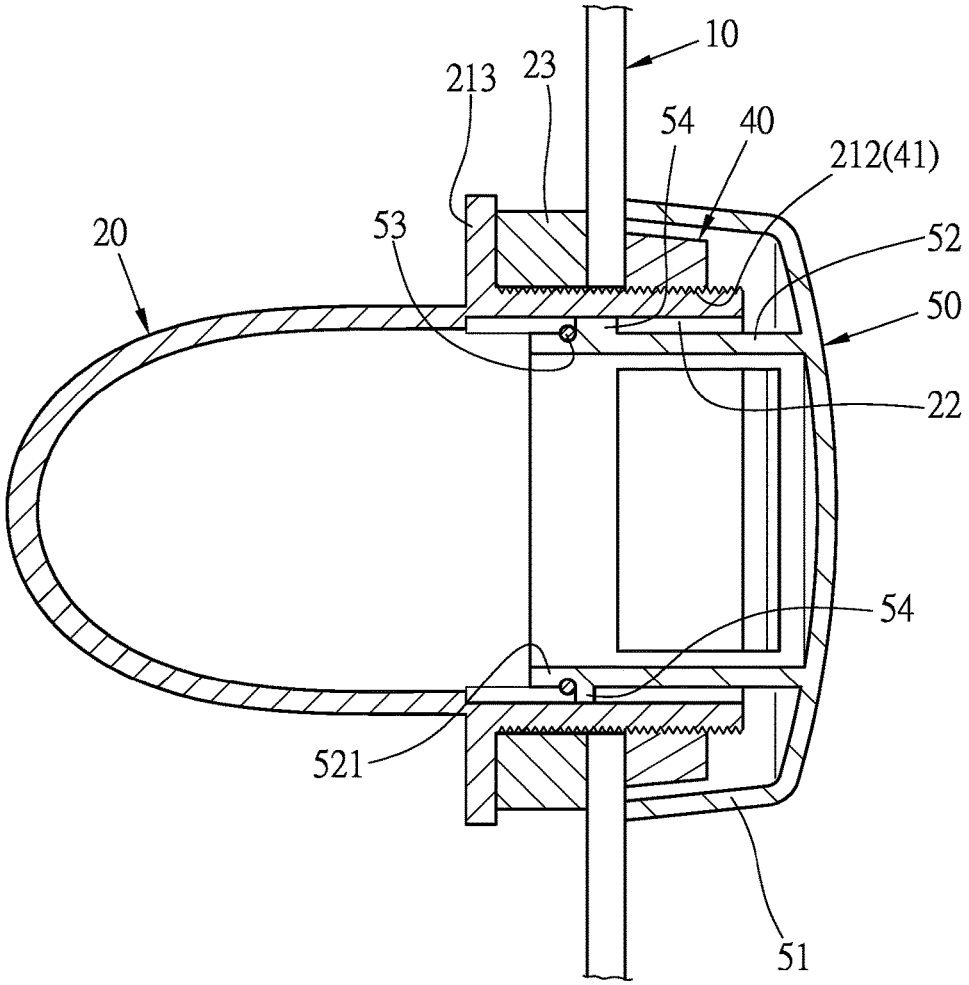
FIG. 4 is a cross sectional view, taken along line 4-4 in FIG. 3.
Figure 5:
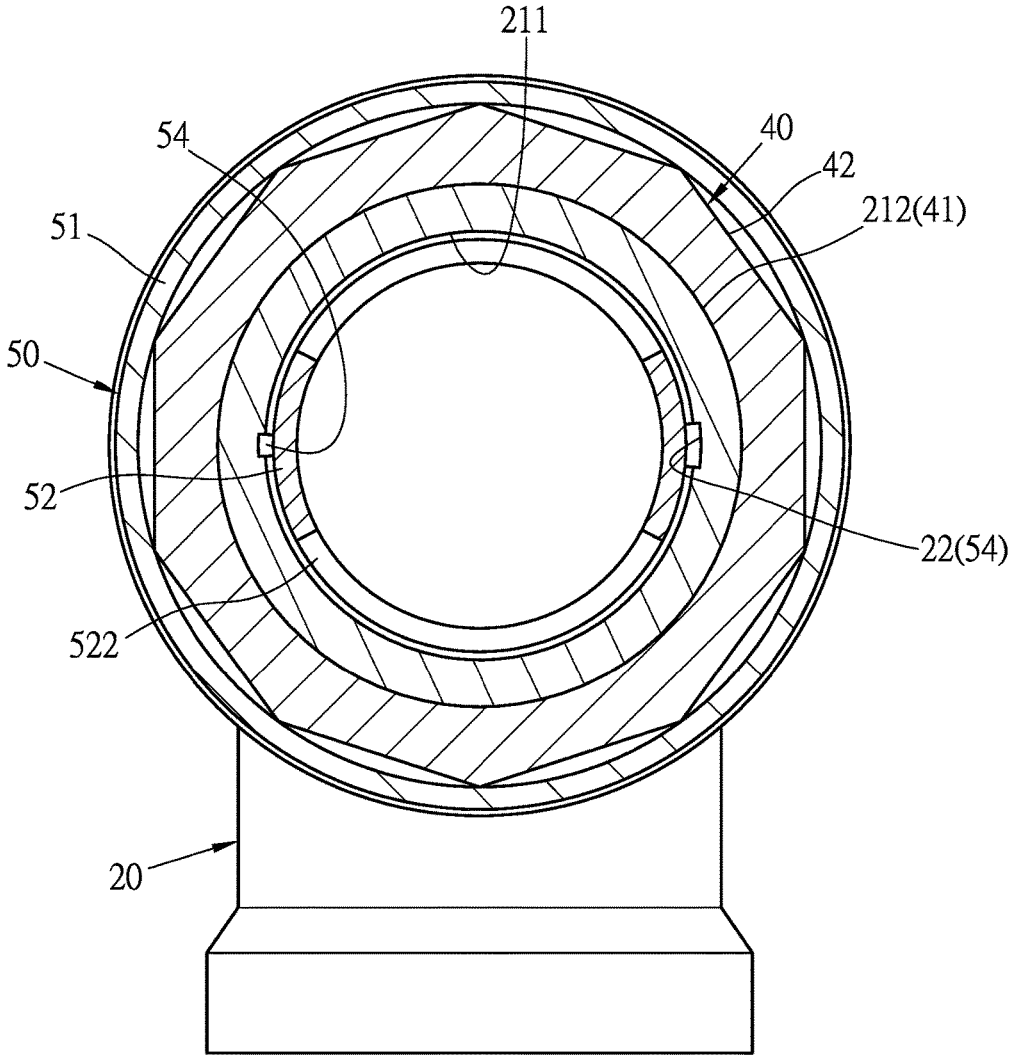
FIG. 5 is a cross sectional view, taken along line 5-5 in FIG. 3.

A cap 50 is mounted to the distal end of the fitting end 21 and has a peripheral wall 51 which includes multiple drain holes 511 defined therethrough. A tubular portion 52 extends centrally and axially from the inner bottom of the cap 50. The tubular portion 52 is inserted into the passage 211 and has a central hole 521. Multiple apertures 522 are defined through the wall of the tubular portion 52 and communicate with the central hole 521 and the drain holes 511. The drain holes 511 and the apertures 522 of the cap 50 are located to communicate with each other along a vertical plane. Two protrusion 54 protrude from outside of the tubular portion 52 and are engaged with the two slots 22 to connect the tubular portion 52 to the overflow pipe 20. The peripheral wall 52 of the cap 50 is mounted to outside of the locking ring 40. A seal ring 54 is mounted to the tubular portion 52 and engaged with the inner periphery of the passage 211 to prevent from leakage as shown in FIG. 4. The seal ring 54 also provides friction so that the cap 50 does not drop from the fitting end 21. As shown in FIG. 5, the tubular portion 52 of the cap 50 is securely inserted into to the fitting end 21 of the overflow pipe 20 by the engagement of the protrusions 54 on the tubular portion 52 and the slots 22 in the fitting end 21, so that the cap 50 does not rotate relative to the fitting end 21. When removing the cap 50, the users pull the cap 50 axially from the locking ring 40 and the fitting end 21.

As shown in FIG. 5, the two protrusions 54 on the tubular portion 52 have different widths, and the two slots 22 in the overflow pipe 20 have different widths which are sized to be engaged with the two protrusions 54 correspondingly. The specific arrangement avoid from incorrect installation and ensures the apertures 522 of the cap 50 to be positioned correctly.

In the present invention, the cap 50 is mounted to the locking ring 40 and is engaged with the fitting end 21 by engagement of the protrusions 54 on the tubular portion 52 and the slots 22 in the fitting end 21. That is to say, the cap 50 is not threadedly connected to the fitting end 21. The water in the bathtub 10 can be drained from the passage 211 of the overflow pipe 20 via the drain holes 511 and the central hole 522.

While we have shown and described the embodiment in accordance with the present invention, it should be clear to those skilled in the art that further embodiments may be made without departing from the scope of the present invention.

What is claimed is:

1. An overflow pipe assembly of a bathtub, comprising:

an overflow pipe having a fitting end horizontally formed on one end thereof, a passage defined through the overflow pipe and communicating with the fitting end, the fitting end having outer threads formed on an outside thereof, a flange extending from the outside of the fitting end, a diameter of the flange being larger than that of the fitting end, a buffering ring mounted to the fitting end, a diameter of the buffering ring being smaller than the diameter of the flange, a first end face of the buffering ring contacting the flange, and a second end face of the buffering ring adapted to contact a wall of the bathtub, at least two slots defined axially in an inner periphery of the passage of the fitting end;

a locking ring having inner threads defined in an inner periphery thereof, the inner threads of the locking ring threadedly connected to the outer threads of the overflow pipe, and a cap mounted to a distal end of the fitting end and having a peripheral wall which includes multiple drain holes defined therethrough, a tubular portion extending centrally and axially from an inner bottom of the cap, the tubular portion inserted into the passage and having a central hole, multiple apertures defined through a wall of the tubular portion and communicating with the central hole and the drain holes, at least one protrusion protruding from outside of the tubular portion and engaged with one of the at least two slots to connect the tubular portion to the overflow pipe, the peripheral wall of the cap mounted to outside of the locking ring.

2. The overflow pipe assembly as claimed in claim 1, wherein the drain holes and the apertures of the cap are located to communicate with each other along a vertical plane.

3. The overflow pipe assembly as claimed in claim 1, wherein the locking ring includes a polygonal driving portion formed on outside thereof.

4. The overflow pipe assembly as claimed in claim 1, wherein there are two protrusions on the tubular portion and the two protrusions are located corresponding to the at least two slots.

5. The overflow pipe assembly as claimed in claim 4, wherein the at least two slots have different widths.

6. The overflow pipe assembly as claimed in claim 1, wherein a seal ring is mounted to the tubular portion and engaged with the inner periphery of the passage.

7. The overflow pipe assembly as claimed in claim 4, wherein the two protrusions have different widths.

* * * * *